US009437953B2

(12) United States Patent
Lappoehn

(10) Patent No.: US 9,437,953 B2
(45) Date of Patent: Sep. 6, 2016

(54) ELECTRICAL PLUG-IN CONNECTOR

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 14/654,059

(22) PCT Filed: Dec. 17, 2013

(86) PCT No.: PCT/DE2013/000812

§ 371 (c)(1),
(2) Date: Jun. 19, 2015

(87) PCT Pub. No.: WO2014/094720

PCT Pub. Date: Jun. 26, 2014

(65) Prior Publication Data

US 2015/0318636 A1 Nov. 5, 2015

(30) Foreign Application Priority Data

Dec. 21, 2012 (DE) ..... 10 2012 025 106

(51) Int. Cl.
*H01R 13/508* (2006.01)
*H01R 13/639* (2006.01)
(Continued)

(52) U.S. Cl.
CPC ..... *H01R 13/508* (2013.01); *H01R 13/6272* (2013.01); *H01R 13/639* (2013.01); *H01R 4/2433* (2013.01)

(58) Field of Classification Search
CPC ..... H01R 13/6275
USPC ..... 439/368, 369, 370, 347, 350–358
See application file for complete search history.

(56) References Cited

U.S. PATENT DOCUMENTS 4,006,957 A * 2/1977 Narozny ..... H01R 12/675 439/405
4,057,879 A * 11/1977 Eigenbrode ..... H02B 1/04 292/87

(Continued)

FOREIGN PATENT DOCUMENTS

DE 10 2004 054 203 A1 5/2006
DE 10 2008 019 016 A1 10/2009

(Continued)

OTHER PUBLICATIONS

International Search Report of PCT/DE2013/000812, mailed Apr. 22, 2014.

(Continued)

*Primary Examiner* — Ross Gushi
(74) *Attorney, Agent, or Firm* — Collard & Roe, P.C.

(57) ABSTRACT

An electrical plug-in connector having a first housing part and having a second housing part, blade contact elements being arranged in the first or second housing part and spring contact elements being arranged in the second or first housing part which are adapted to the blade contacts and can be inserted therein, has a locking clip which, when it engages around the first or second housing part in a manner substantially parallel to the plug-in direction when the two housing parts are plugged into each other, can be locked in or on the second or first housing part.

7 Claims, 3 Drawing Sheets

(51) Int. Cl.
*H01R 13/627* (2006.01)
*H01R 4/24* (2006.01)

(56) References Cited

U.S. PATENT DOCUMENTS 4,168,877 A * 9/1979 Little ..... H01R 13/62994 361/788
4,188,083 A * 2/1980 Knowles ..... H01R 12/675 439/405
4,341,428 A * 7/1982 Hatch ..... H01R 13/6456 439/157
4,359,257 A * 11/1982 Lopinski ..... H01R 12/675 439/405
4,412,714 A * 11/1983 Morningstar ..... H01R 12/675 439/352
4,475,786 A * 10/1984 Root ..... H01R 12/675 439/404
4,538,873 A * 9/1985 Worth ..... H01R 23/66 439/404
4,621,885 A * 11/1986 Szczesny ..... H01R 12/675 439/357
4,668,039 A * 5/1987 Marzili ..... H01R 12/675 439/404
4,693,533 A * 9/1987 Szczesny ..... H01R 12/675 439/350
4,753,608 A * 6/1988 Yamaguchi ..... H01R 12/675 439/395
4,897,041 A * 1/1990 Heiney ..... H01R 23/661 439/404
4,917,625 A 4/1990 Haile
4,973,255 A * 11/1990 Rudoy ..... H01R 13/62994 439/157
5,100,342 A * 3/1992 Olsson ..... H01R 13/41 439/494
5,108,306 A * 4/1992 Wellinsky ..... H01R 12/675 439/404
5,125,850 A * 6/1992 Locati ..... H01R 12/675 439/404
5,151,049 A * 9/1992 Mosquera ..... H01R 12/675 439/353
5,338,221 A * 8/1994 Bowen ..... H01R 12/675 439/405
5,613,870 A * 3/1997 Traver, Jr. ..... H01R 13/6273 439/352
5,639,259 A * 6/1997 Wellinsky ..... H01R 23/661 439/470
5,762,513 A * 6/1998 Stine ..... H01R 12/675 439/358
5,779,495 A * 7/1998 Dechelette ..... H01R 13/6275 439/352
5,820,403 A * 10/1998 Cheng ..... H01R 12/675 439/404
6,036,531 A * 3/2000 Lee ..... H01R 12/675 439/405
6,048,222 A * 4/2000 Price ..... H01R 12/675 439/358
6,074,237 A * 6/2000 Lee ..... H01R 4/2433 439/358
6,146,179 A * 11/2000 Denny ..... H01R 13/6335 439/350
6,171,131 B1 * 1/2001 Lee ..... H01R 13/6273 439/358
6,179,642 B1 * 1/2001 Hwang ..... H01R 13/5804 439/358
6,193,541 B1 * 2/2001 Lee ..... H01R 12/675 439/358
6,203,359 B1 * 3/2001 Lee ..... H01R 13/5812 439/405
6,347,957 B1 * 2/2002 Hwqng ..... H01R 13/5812 439/405
6,379,173 B1 * 4/2002 Fonteneau ..... H01R 13/6273 439/352
6,394,842 B1 * 5/2002 Sakurai ..... H01R 23/688 439/352
6,398,575 B1 * 6/2002 Bresson ..... H01R 13/6273 439/352
6,416,349 B1 * 7/2002 Lee ..... H01R 12/675 439/404
6,655,980 B2 * 12/2003 Lee ..... H01R 13/6275 439/358
6,663,412 B2 * 12/2003 Aramoto ..... H01R 13/6273 439/357
6,666,706 B1 * 12/2003 Jones ..... H01R 13/506 439/353
6,761,576 B1 * 7/2004 Ye ..... H01R 4/2433 439/404
6,817,887 B2 * 11/2004 Jones ..... H01R 13/6275 439/405
6,855,000 B2 * 2/2005 Wu ..... H01R 13/6335 439/476.1
6,884,106 B2 * 4/2005 Shuman ..... H01R 13/6456 439/352
6,974,344 B2 * 12/2005 Comerci ..... H01R 23/661 439/329
7,201,601 B2 * 4/2007 Lappohn ..... H01R 4/2433 439/404
7,413,485 B2 * 8/2008 Lappoehn ..... H01R 13/4365 439/357
7,503,797 B2 * 3/2009 Lappoehn ..... H01R 4/2433 439/404
7,946,880 B2 * 5/2011 Tsai ..... H01R 13/506 439/358
8,100,710 B1 * 1/2012 Peng ..... H01R 12/7011 439/369
8,547,691 B2 * 10/2013 Peng ..... H01R 13/6395 361/679.4
8,986,037 B2 * 3/2015 Boemmel ..... H01R 13/4361 439/357
2009/0258530 A1 10/2009 Nehm
2014/0349513 A1 * 11/2014 Mathews ..... H01R 12/675 439/470
2014/0370734 A1 * 12/2014 Mathews ..... H01R 13/629 439/157
2015/0318636 A1 * 11/2015 Lappoehn ..... H01R 13/508 439/660
2015/0349451 A1 * 12/2015 Lappoehn ..... H01R 13/6272 439/660

FOREIGN PATENT DOCUMENTS

DE 10 2010 032 013 A1 1/2012
EP 1 139 494 A2 10/2001

OTHER PUBLICATIONS

German Office Action in DE 10 2012 025 106.8, dated Aug. 21, 2013, with English translation of relevant parts.

* cited by examiner

ELECTRICAL PLUG-IN CONNECTOR

CROSS REFERENCE TO RELATED APPLICATIONS

This application is the National Stage of PCT/DE2013/000812 filed on Dec. 17, 2013, which claims priority under 35 U.S.C. §119 of German Application No. 10 2012 025 106.8 filed on Dec. 21, 2012, the disclosure of which is incorporated by reference. The international application under PCT article 21(2) was not published in English.

The invention relates to an electrical plug-in connector having a first housing part and a second housing part, wherein blade contact elements are arranged in the first or second housing part and spring contact elements which are adapted to the blade contact elements and are able to be inserted into them are arranged in the second or first housing part.

PRIOR ART

Such plug-in connectors are widespread in the prior art.

Thus, for example, an electrical plug-in connector of the type conforming to its genre arises from DE 10 2004 054 203 A1, in which an insulation displacement plug-in contact strip is provided.

DE 10 2008 019 016 A1 discloses an electrical plug-in connector that has locking clips for locking two housing parts. Two locking clips are provided which are mounted for rotation on bearing pins arranged on a housing part of the plug-in connector. This rotatable mounting of both locking clips requires complex, time-consuming production; moreover, the bearing pins and, in particular, the locking protrusions that serve for the locking are easily exposed to damage. In addition, two locking clips must be actuated and arrested in order to ensure a secure locking of both housing parts of the plug-in connector.

A similar secondary locking agent on a plug-in connector housing arises from DE 10 2010 032 013 A1. In this case as well, both locking clips must be mounted for rotation on a housing part. Two locking clips are also provided here.

DISCLOSURE OF THE INVENTION

Advantages of the Invention

The electrical plug-in connector according to the invention, in contrast, has the advantage that the locking clip does not have to be fastened to a housing, but rather can be handled as a separate component. This is therefore advantageous because, for example, if the locking clip is damaged, an exchange of the locking clip with an undamaged locking clip is easily possible. Furthermore, the locking clip according to the invention is designed to be substantially more massive and stable than the locking clips known from the prior art. It is particularly advantageous that the locking clip according to the invention is, in particular, able to be a secondary locking clip which provides additional security for a plug-in connection that is already locked, such that this is able to be used in particularly critical environments (for example environments that are subject to heavy vibrations and so forth). A tongue having a latching hook, arranged on the second housing part, for example, and an opening arranged in the first housing part, with which opening the latching hook engages, are provided as the primary locking agent. A locking clip is provided according to the invention which is able to be locked in/on the second or first housing part while it encloses the first or second housing part substantially parallel to the plugging direction, when both housing parts are plugged into each other. A particularly stable connection of the two plug-in connector parts that are plugged into each other is hereby implemented.

By the measures described herein, advantageous developments and improvements of the plug-in connector are possible.

One advantageous embodiment thus provides that guide elements for guiding the clip arms of the locking clip, which run substantially parallel to the plugging direction, are arranged in the first or second housing part. In this way, a precise guiding of the locking clip on the one housing part is implemented and, at the same time, a fastening of the clip arms of the locking clip to the housing part is also enabled.

Moreover, provision is advantageously made for latch elements for locking with the counterpart latch elements arranged on the clip arms to be provided in the second or first housing part. The counterpart latch elements arranged on the clip arms lock with the latch elements, wherein a precise guiding, and therefore also a precise locking of the latch elements to one another is ensured by the guide elements.

Purely as a matter of principle, the locking clips may be designed in a different manner. One particularly advantageous embodiment provides that the locking clips are designed in a U shape with two U-shaped legs that are bent fundamentally orthogonally from a base. Such a U-shaped design is used particularly advantageously in the case of mostly cuboidal plug-in connector housing parts.

Provision is highly advantageously made for the U-shaped legs to have grooves as guide elements on their respective inner side facing the first or second housing part, with which grooves protrusions that are adapted to them and are arranged on the outer sides running parallel to the plugging direction engage in a sliding manner. The guide elements are therefore implemented by grooves and by protrusions engaging therewith. This enables, on the one hand, a precise guiding of the locking clip, but on the other hand enables an optimal fastening of the locking clip to the housing part having the protrusions.

Provision is particularly advantageously made for the U-shaped legs to have latching hooks as counterpart elements on their ends, said latching hooks interacting with snap-in noses arranged on the first or second housing part. The interaction of the grooves, together with the protrusions and the latching hooks, with the snap-in noses arranged on the housing part enables precise guiding of the U-shaped legs and thus also a precise latching of the latching hooks into the snap-in noses. In order to simplify this latching, provision is advantageously made for the latching hooks and the snap-in noses to have sliding surfaces on their sides facing one another that are adapted to one another and that run obliquely.

The locking clips can, purely as a matter of principle, consist of highly different materials. They are particularly advantageously designed as a plastic part which is not only easy to produce, but is also particularly light and at the same time has insulating properties.

BRIEF DESCRIPTION OF THE DRAWINGS

One exemplary embodiment of the invention is depicted in the drawings and illustrated in greater detail in the description below.

Shown are:

FIG. 2 an isometric depiction of the plug-in connector depicted in FIG. 1 after both plugged into each other and before the fastening of the locking clip, and FIG. 3 the plug-in connector according to the invention depicted in FIG. 1 and FIG. 2 when both housing parts are plugged into each other and when the locking clip is plugged in.

EMBODIMENTS OF THE INVENTION

Figure 1:
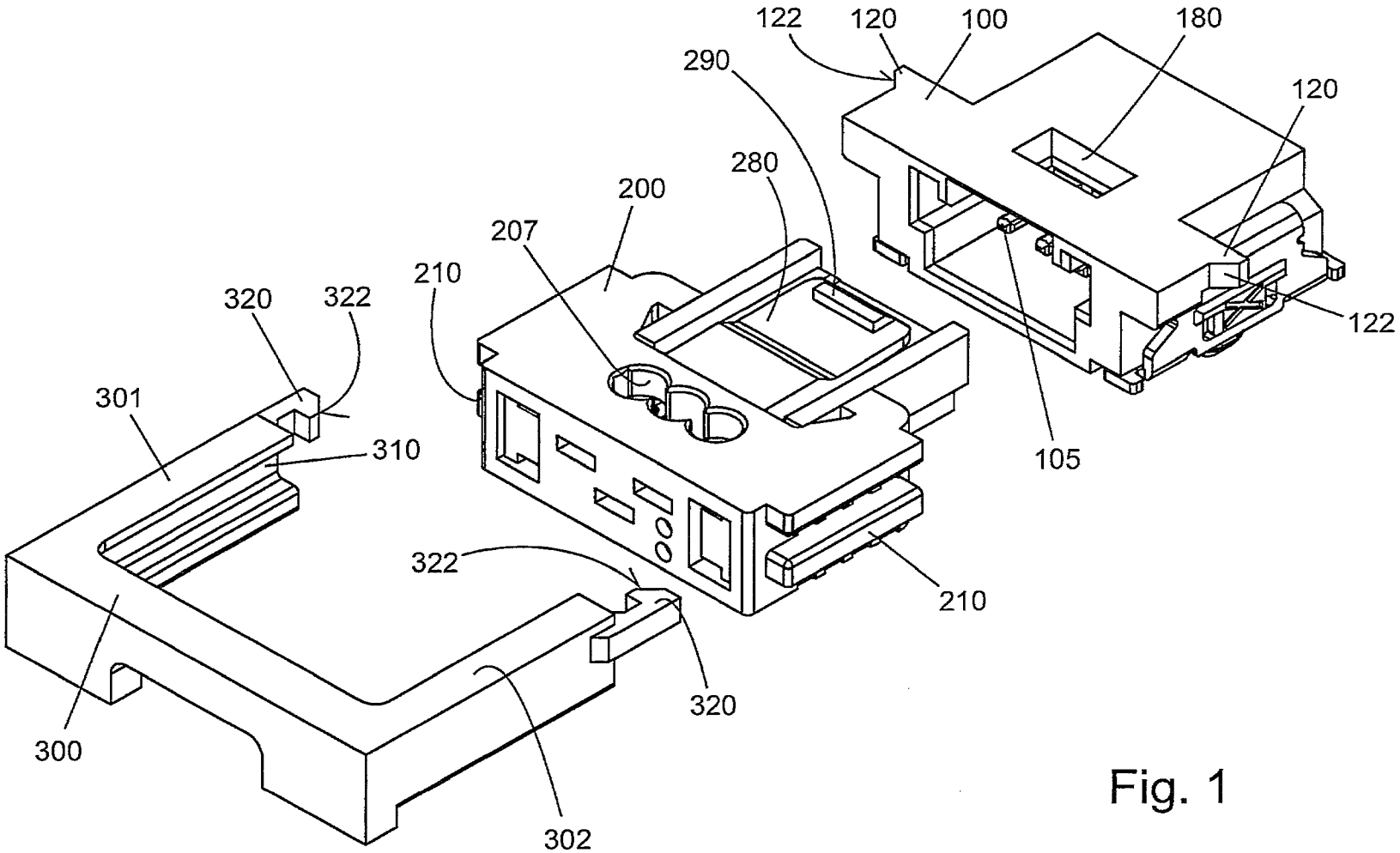
FIG. 1 an isometric depiction of a plug-in connector according to the invention before both housing parts are plugged into each other and of the locking clip.
Figure 2:
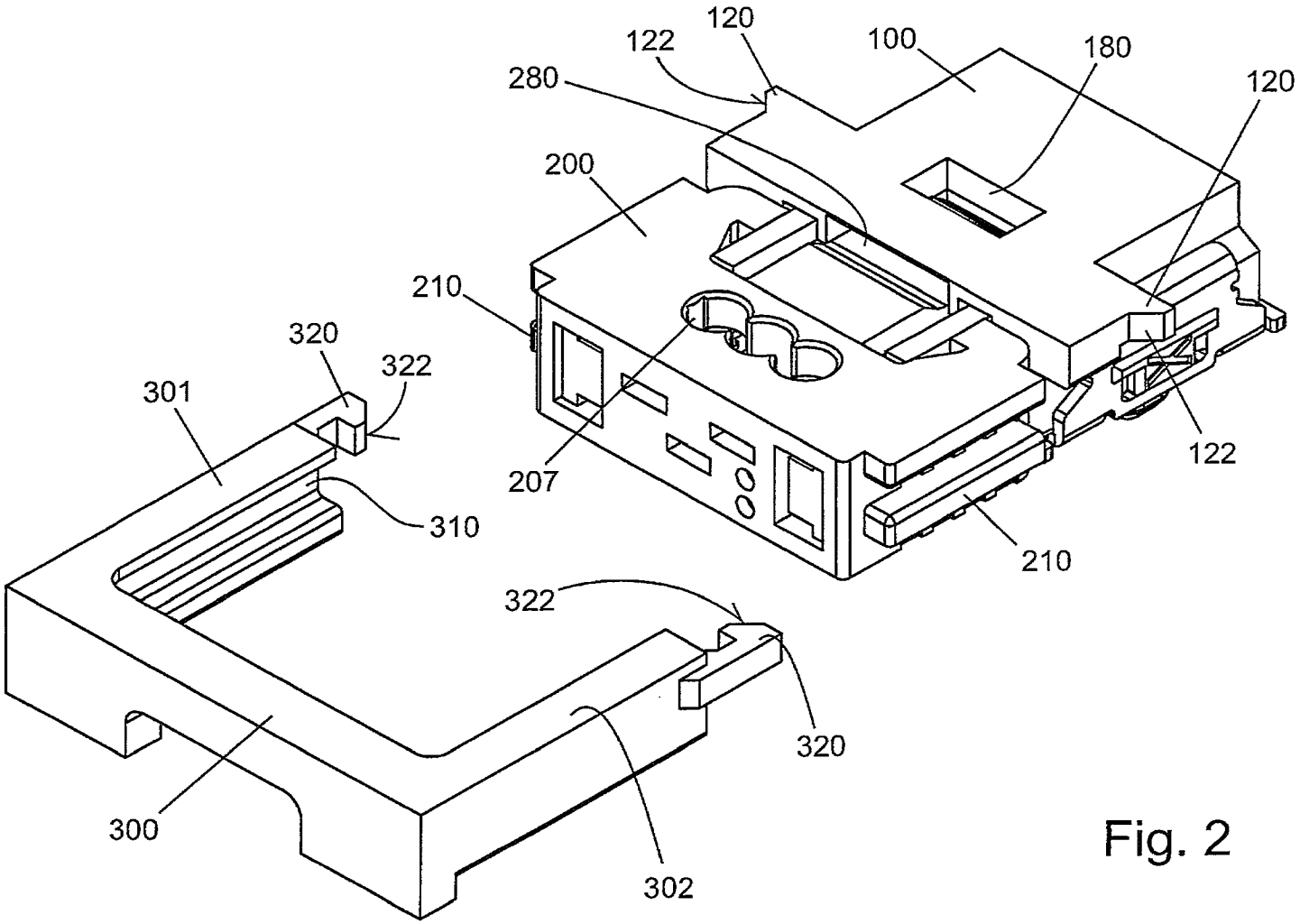
Figure 3:
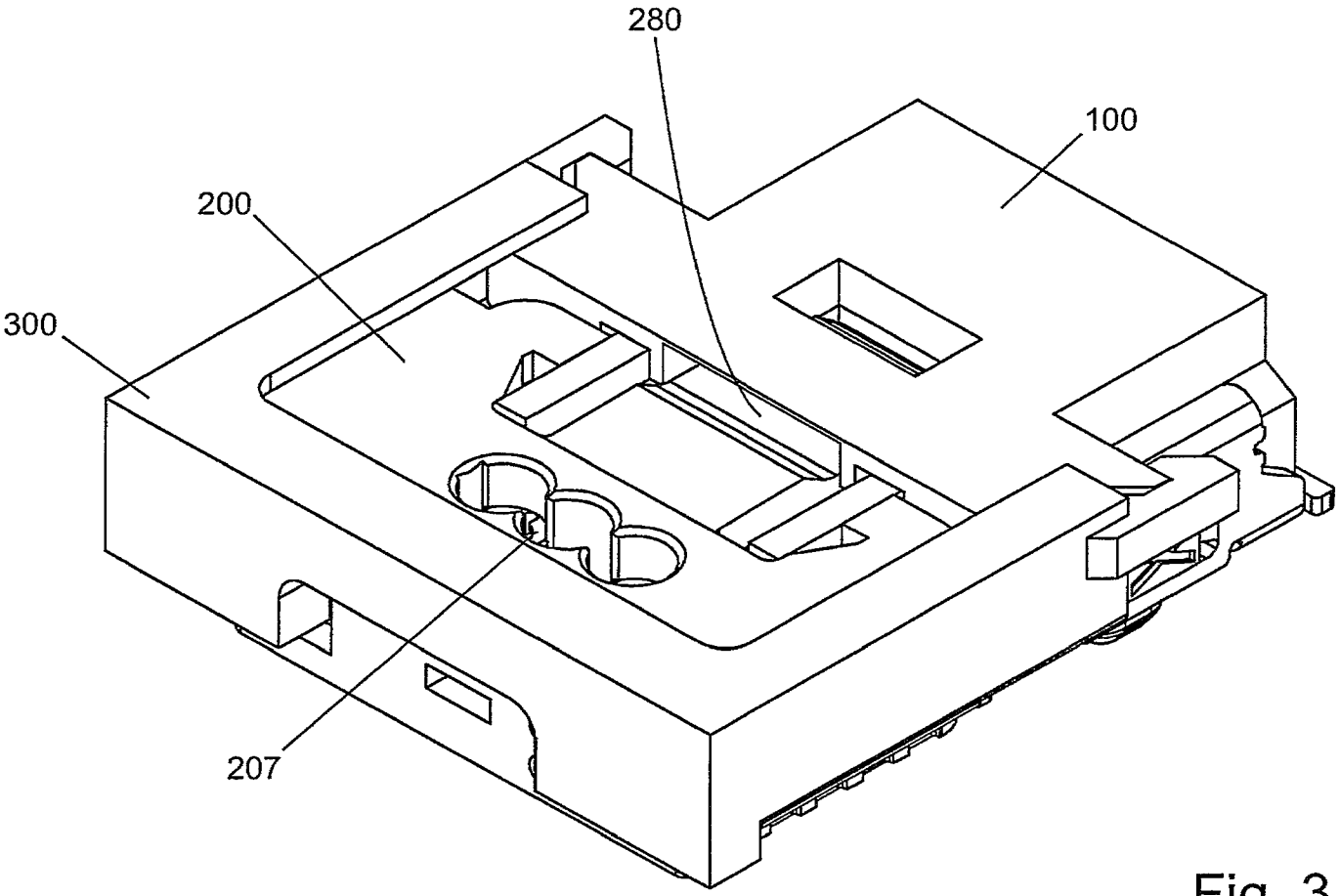

An electrical plug-in connector, depicted in FIGS. 1 to 3 in different plugging states, has a first housing part 100 in which first plug contact elements, for example blade contact elements 105, are arranged. Adapted to this first housing part 100 is a second housing part 200, which is able to be plugged into the first housing part 100 in a manner that is known in itself, and in which corresponding counterpart contact elements, i.e. spring contacts (not visible here) are arranged.

A locking clip 300 is moreover provided, which has a substantially U-shaped configuration with U-shaped legs. 301, 302. The inner side of the U-shaped legs 301, 302 has U-shaped grooves 310 which are adapted to corresponding protrusions 210 that are designed here to be cuboidal, said protrusions being fitted onto the outer sides of the second housing part 200 of the plug-in connector, in such a way that the cuboidal protrusions 210 are able to be slid into the grooves 310 of the locking clip 300. Latching hooks 320 are formed on the respective ends of the U-shaped limbs 301, 302, the front sides of which hooks, so their sides facing both housing parts 100, 200, having a respective slope 322. These obliquely running surfaces 322 are adapted to corresponding obliquely running surfaces 122 of snap-in noses 120 which are arranged on the first housing part 100.

FIG. 1 shows the unplugged state of both housing parts 100, 200, whereas FIG. 2 shows the plugged state of both housing parts 100, 200. FIG. 1 and FIG. 2 each show the unlocked state, whereas FIG. 3 shows the plugged and locked state of both housing parts 100, 200. As can be gleaned from FIGS. 1 and 2, the housing part 200 has an elastic tongue 280 having a snap-in nose 290 that engages with an opening 180 provided in the housing part 100. Tongue 280, snap-in nose 290 and opening 180 thus already act as a primary locking agent, which ensures a locking of both housing parts 200 and 100 to each other. This locking is additionally ensured by the locking clip 300 that acts in this case as a secondary locking agent. After both housing parts 100, 200 have been plugged into each other, the locking clip 300 is slid above the second part 200, wherein the protrusions 210 engage with the grooves 310 and slide into the grooves 310. Then the latching hooks 320 lock on or with the snap-in noses 120 of the first housing part 100. The locking takes place while the second housing part 200 is secured by the locking clip 300. In this instance, the extensively arranged protrusions 210, which practically completely fill the grooves 310 in the locked state, prove to be highly advantageous. They enable not only a precise guiding of both U-shaped legs 301, 302 and thus also a precise guiding of the latching hooks 320 in the direction of the snap-in noses 120. They also enable a secure holding of the second housing part 200, in particular if pressure is exerted perpendicularly to the plugging direction, which is possible purely in principle, since the eduction of the electrical conductors takes place perpendicularly to the drawing plane by a ribbon cable or even individual wires, for example, being inserted into the opening 207, said cable or wires being contacted by means of insulation displacement contact in the second housing part 200, for example in the manner described in DE 10 2004 054 203 A1. The housing part 100 is, however, arranged on a circuit board, for example, and the contact elements are contacted on the circuit board by corresponding conducting paths. Purely as a matter of principle, the housing part 100 could, however, be designed in such a way that the electrical conductors are guided away perpendicularly from the drawing plane, such as in the case of the housing part 200, or even in parallel to the drawing plane, so parallel to the plugging direction.

The locking clip 300 is preferably a plastic part which has a certain level of elasticity, is light and is moreover also electrically insulating. The advantage of the described design of the locking clip 300 can be seen in that it is designed as a separate part. This enables not only simple handling, but it can also be exchanged easily if damaged and can be replaced by an undamaged locking clip 300. It furthermore extensively encloses the housing part 200, which ensures a secure locking, even secondary locking, of the second housing part 200 to the first housing part 100. Not only is a precise and firmly orientated guiding of the locking clip on the second housing part 200 and the latch elements on the first housing part 100 possible by the grooves formed in the inner sides of its legs 301, 302, which interact with corresponding protrusions 210 on the second housing part 200, but a particularly stable locking is also hereby achieved.

The invention claimed is:

1. Electrical plug-in connector having a first housing part and having a second housing part, wherein first contact elements are arranged in the first housing part and second contact elements that are able to be plugged into the first contact elements are arranged in the second housing part, wherein a locking clip is able to be locked on the first housing part while it partially encloses the second housing part when both housing parts are plugged into each other, wherein guide elements running substantially parallel to the plugging direction are arranged in the second housing part for guiding clip arms of the locking clip, wherein latch elements are provided in the first housing part for locking with counterpart latch elements arranged on the clip arms, wherein the locking clip is designed to be U-shaped, wherein the clip arms are two U-shaped leas that are bent fundamentally orthogonally from a base, and wherein the guide elements arranged on the second housing part are designed as protrusions, wherein the U-shaped legs have grooves on their respective inner side, wherein the grooves face towards the protrusions on the second housing part, with which grooves the protrusions engage in a sliding manner.

2. Electrical plug-in connector according to claim 1, wherein the U-shaped legs have latching hooks as counterpart latch elements on their ends, which interact with latch elements formed as a snap-in nose on the first housing part.

3. Electrical plug-in connector according to claim 2, wherein each of the latching hooks has a respective latching hook longitudinal axis and a latching hook sliding surface running obliquely to the latching hook longitudinal axis and each of the snap-in noses has a respective snap-in nose longitudinal axis and a snap-in nose sliding surface running obliquely to the snap-in nose longitudinal axis.

4. Electrical plug-in connector according to claim 1, wherein the locking clip comprises plastic.

5. Electrical plug-in connector according to claim 1, wherein both housing parts have primary locking agents and the locking clip acts as a secondary locking agent.

6. Electrical plug-in connector according to claim 5, wherein the primary locking agent is formed by: a tongue arranged on the second housing part, having a latching hook that engages with an opening arranged in the first housing part.

7. Electrical plug-in connector according to claim 1, wherein the grooves are open in the plugging direction.

* * * * *